US007559362B2

(12) United States Patent
Miner

(10) Patent No.: US 7,559,362 B2
(45) Date of Patent: Jul. 14, 2009

(54) DOWNHOLE FLOW REVERSAL APPARATUS

(76) Inventor: Daniel P. Miner, 4330 S. Center St., Casper, WY (US) 82601-6009

( * ) Notice: Subject to any disclaimer, the term of this patent is extended or adjusted under 35 U.S.C. 154(b) by 0 days.

(21) Appl. No.: 11/710,363

(22) Filed: Feb. 23, 2007

(65) Prior Publication Data

US 2008/0202743 A1 Aug. 28, 2008

(51) Int. Cl.
*E21B 43/00* (2006.01)
*E21B 43/14* (2006.01)

(52) U.S. Cl. ..... 166/105; 166/266; 166/369

(58) Field of Classification Search ..... 166/263, 166/223, 266, 313, 68, 105
See application file for complete search history.

(56) References Cited

U.S. PATENT DOCUMENTS

| | | | | |
|---|---|---|---|---|
| 3,807,714 | A | 4/1974 | Hollyer | 266/134 |
| 4,310,020 | A | 1/1982 | Jespersen et al. | 137/563 |
| 5,241,723 | A * | 9/1993 | Garrabrant | 15/316.1 |
| 5,992,432 | A | 11/1999 | Hörger et al. | 134/167 C |
| 6,457,531 | B1 * | 10/2002 | Bangash et al. | 166/369 |
| 6,564,865 | B1 | 5/2003 | Brady et al. | 166/105.3 |
| 6,672,387 | B2 | 1/2004 | Brady et al. | 166/266 |
| 7,090,018 | B2 | 8/2006 | Livingstone | 166/312 |
| 2004/0244974 | A1 * | 12/2004 | Zupanick et al. | 166/267 |
| 2005/0051335 | A1 | 3/2005 | Davis et al. | 166/312 |
| 2006/0278395 | A1 | 12/2006 | Kenison et al. | 166/312 |

* cited by examiner

*Primary Examiner*—David J Bagnell
*Assistant Examiner*—Brad Harcourt
(74) *Attorney, Agent, or Firm*—Alfred J. Mangels

(57) ABSTRACT

A water reinjection arrangement for a coal bed methane well to minimize water disposal problems at the well surface. Water is withdrawn by a motor driven pump from an upper coal seam through openings in the upper portion of the well casing. A flow reversing head is provided within the well casing and into which the withdrawn water is directed. The water flow direction is reversed by about 180° and is conveyed within the well casing through tubular conduits to a downstream flow collector and into a downflow pipe, to be injected into a lower seam through openings in a lower portion of the well casing wall. A sealing arrangement is provided within the well casing to seal off the upper coal seam from the lower seam.

10 Claims, 7 Drawing Sheets

DOWNHOLE FLOW REVERSAL APPARATUS

BACKGROUND OF THE INVENTION

1. Field of the Invention

The present invention relates to a flow reversal arrangement for a downhole water pump positioned within a coal bed methane well casing. More particularly, the present invention relates to a water flow reversing structure positioned at a pump flow outlet, along with associated conduits for conveying the reversed flow to an elevation within the well casing that is below the elevation of the pump.

2. Description of the Related Art

An important source of methane, a major constituent of natural gas, is subsurface coal seams that contain methane. Coal bed methane is a byproduct of the decomposition of organic material and is held to coal particulates by water that is present within the coal seam. However, in such subsurface coal seams the gas is not readily available because it is trapped in the seam by the water. Thus, to liberate the gas, wells are sunk and include submersible pumps positioned within well casings for removing the water from the coal seam to lower the water pressure and thereby liberate the gas. The gas passes into the well casing and is pumped to the surface, where it is collected at the surface after water has been extracted from the coal seam. Such wells are referred to as coal bed methane wells.

The water withdrawn from the coal seams is generally pumped to the surface by submersible pumps driven by electric motors that receive electrical power from the surface by means of an electric cable. The composition of the water contained in such coal seams can vary, but in general it is of low quality because it contains large quantities of dissolved mineral solids, including dissolved sodium and bicarbonate. As a result, the water has salinity levels that make it unsuitable for plants and for discharge onto soils, although it can be and has been used as drinking water for livestock. Consequently, when large volumes of subsurface water from coal seams are brought to the surface, a disposal problem is presented by the excess water that cannot otherwise be effectively and economically utilized. One way to minimize the disposal problem is to reinject the water back into the ground, such as into seams that previously had the methane gas liberated. Another way is to reinject the water into the ground at a different elevation from that from which the methane is being withdrawn.

There is therefore a need for a compact and simple flow reversal arrangement that can be contained within a coal bed methane well casing for injecting extracted coal bed seam water into lower strata.

SUMMARY OF THE INVENTION

Briefly stated, in accordance with one aspect of the present invention, a fluid flow reversal apparatus is provided for subsurface pumping systems and positioned in a well casing. The apparatus includes a pump having an inlet and an outlet, wherein flow from the pump outlet issues in an upward direction toward the surface. Means are provided for driving the pump, and a flow reverser is positioned adjacent the pump outlet for redirecting pump outlet flow through an angle of about 180° relative to the upward direction. Conduit means are connected with the flow reverser for collecting reversed flow that issues from the flow reverser and for conveying the reversed flow in a downward direction substantially 180° from the upward direction.

BRIEF DESCRIPTION OF THE DRAWINGS

The structure, operation, and advantages of the present invention will become further apparent upon consideration of the following description, taken in conjunction with the accompanying drawings in which.

DESCRIPTION OF THE PREFERRED EMBODIMENTS

Figure 1:
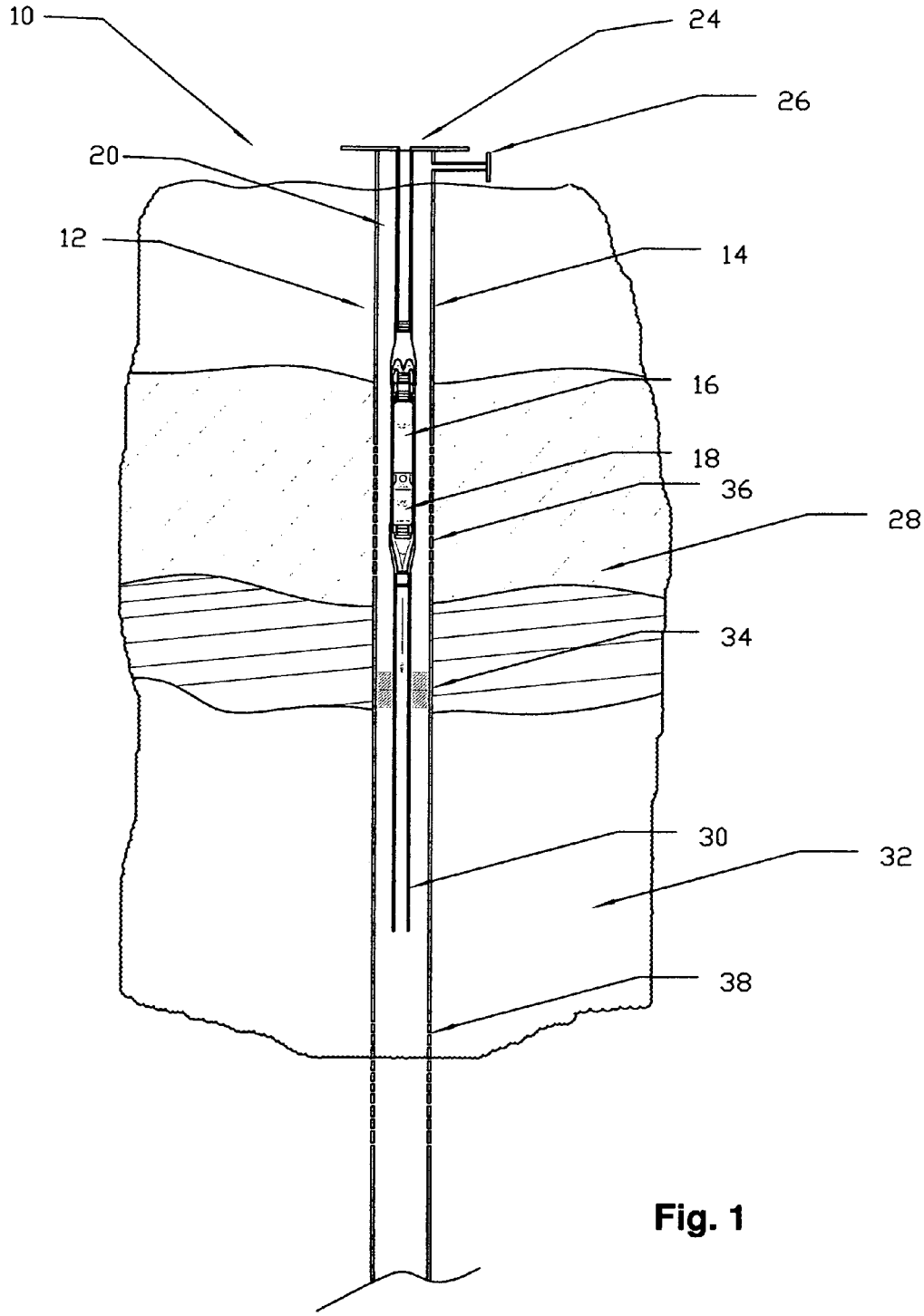
FIG. 1 is an elevational view of a longitudinal section through a typical coal bed methane well casing that includes a submersible pump that forms part of a coal bed methane recovery system.

Referring now to the drawings, and particularly to FIG. 1 thereof, there is shown a longitudinal section through a typical coal bed methane well 10. A borehole 12 extends into the earth through successive formation layers from the surface, and a tubular well casing 14 is provided within borehole 12. A submersible pump 16 and an electric motor 18 are positioned within well casing 14. Pump 16 and motor 18 are in the form of a coaxial cylindrical assembly that has a smaller outer diameter that the inner diameter of well casing 14 to define an annular flow passageway 20 therebetween.

The upper end of the pump and motor assembly is connected with a coaxial upper positioning pipe 22 that extends upwardly to and is secured to a well outlet 24. The well outlet includes a support for pipe 22, as well as a methane gas takeoff connection 26 that is in communication with annular flow passageway 20. The pump and motor assembly is positioned adjacent to a coal seam 28 for withdrawing water from the seam in order to liberate trapped methane gas that is contained within the coal seam. Connected to and extending below the pump and motor assembly is a water downflow pipe 30 that extends to a lower seam 32 that is at a lower elevation than coal seam 28. A sealing arrangement 34, which can be in the form of a mechanical packer, or the like, is positioned between water downflow pipe 30 and well casing 14 in order to seal off upper coal seam 28 from lower seam 32.

Well casing 14 includes a number of upper openings 36 provided in the casing wall opposite coal seam 28. Upper openings 36 in well casing 14 can be a series of circumferentially and axially spaced apertures of any desired form and size to allow flow therethrough of a sufficient volume of water from coal seam 28 into annular flow passageway 20. The upper openings allow water from the coal seam to enter the annular space above sealing arrangement 34 and between well casing 14 and the pump and motor assembly, and to be drawn into the inlet of pump 16 to be pumped from the level of coal seam 28. Normally, water withdrawn from coal seam 28 would be pumped to the surface through upper support pipe 22, but with the present invention the coal seam water is, instead, directed downwardly to lower level seam 32.

In addition to upper openings 36, well casing 14 also includes a number of lower openings 38. The lower openings in the well casing are provided at a level below sealing arrangement 34, and they can have a similar form and distribution as upper openings 36, if desired. Lower openings 38 serve to allow flow of water that issues from the pump and motor assembly to flow through water downflow pipe 30 into well casing 14 below sealing arrangement 34 and into lower seam 32, either to replenish previously-withdrawn water from that seam, or to add water to that seam and thereby obviate the need to handle and dispose of withdrawn water at some point above the surface.

Figure 2:
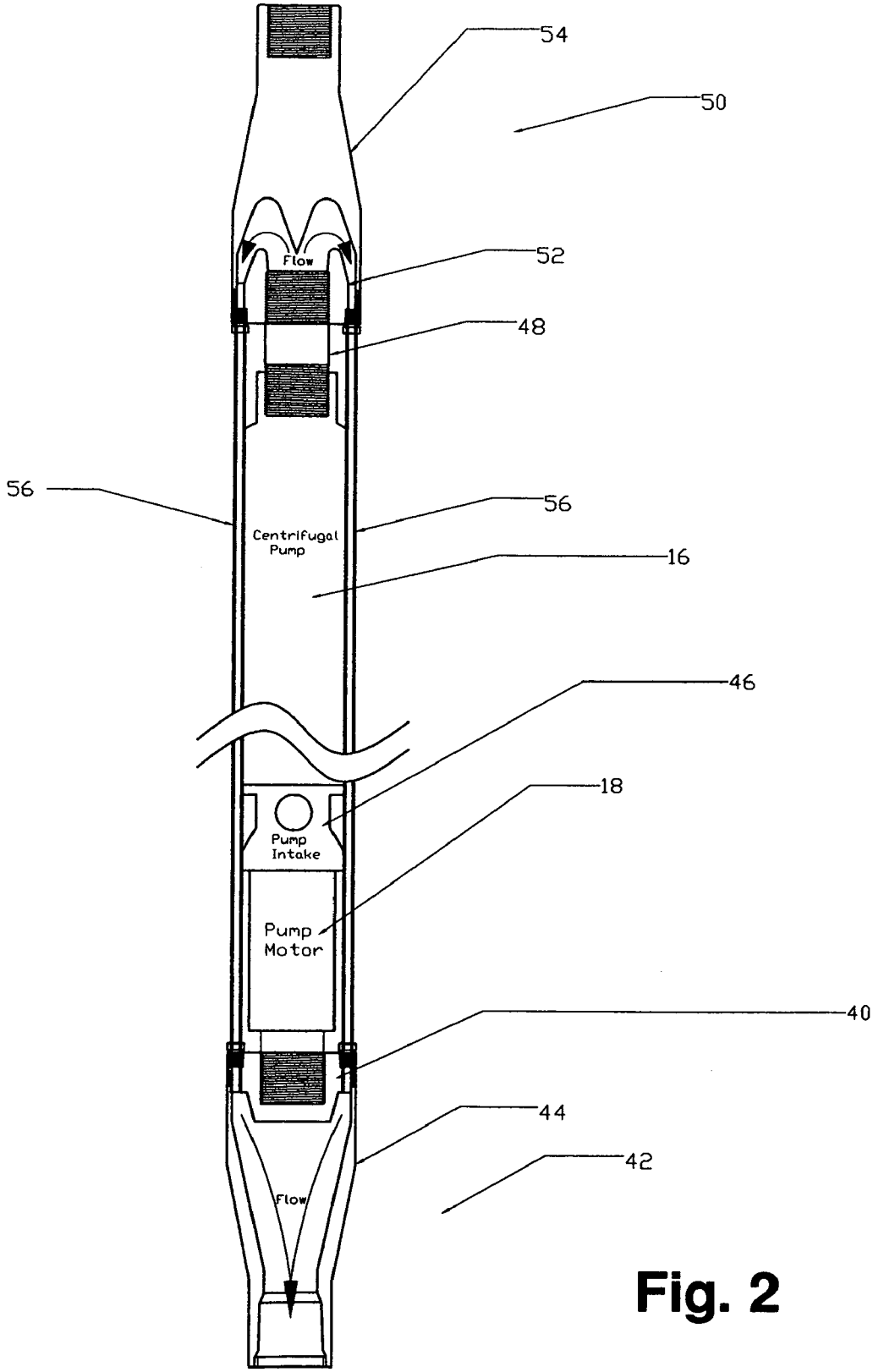
FIG. 2 is an elevational view of the submersible pump portion of the system shown in FIG. 1, including flow reversing apparatus in accordance with an embodiment of the present invention.

The pump and motor assembly is shown in enlarged form in FIG. 2. As shown, pump 16 is a centrifugal pump, although other pump types that can be accommodated within the well casing can also be utilized. Pump 16 is driven by submersible electric motor 18 that receives electrical power through a power cable (not shown) that extends from the motor to the well surface to connect with a surface source of electrical power. Pump motor 18 is supported at its lower end in an annular inner collector head 40 that forms part of a downstream flow collector 42 with an outer collector conduit 44. The upper end of motor 18 is drivingly connected with the lower end of the pump at a point adjacent to the pump intake 46.

The upper end of pump 16 includes a discharge conduit 48 that communicates with and is connected to a flow reversing head 50. Flow reversing head 50 includes an inner flow divider 52 that receives and divides pump outlet flow and is of annular form, and an outer flow diverter 54 that is connected to inner flow divider 52 for receiving pump outlet flow and for changing the direction of flow of the pump discharge. Extending from flow reversing head 50 to downstream flow collector 42 are a number of parallel, circumferentially disposed, outer conduits 56 that collectively surround pump 16 and motor 18, and that convey water discharged by the pump and into flow reversing head 50 in a downward direction to downstream flow collector 42. Although described and illustrated herein as a number of individual outer conduits, a single annular conduit can instead be utilized, if desired.

Figure 3:
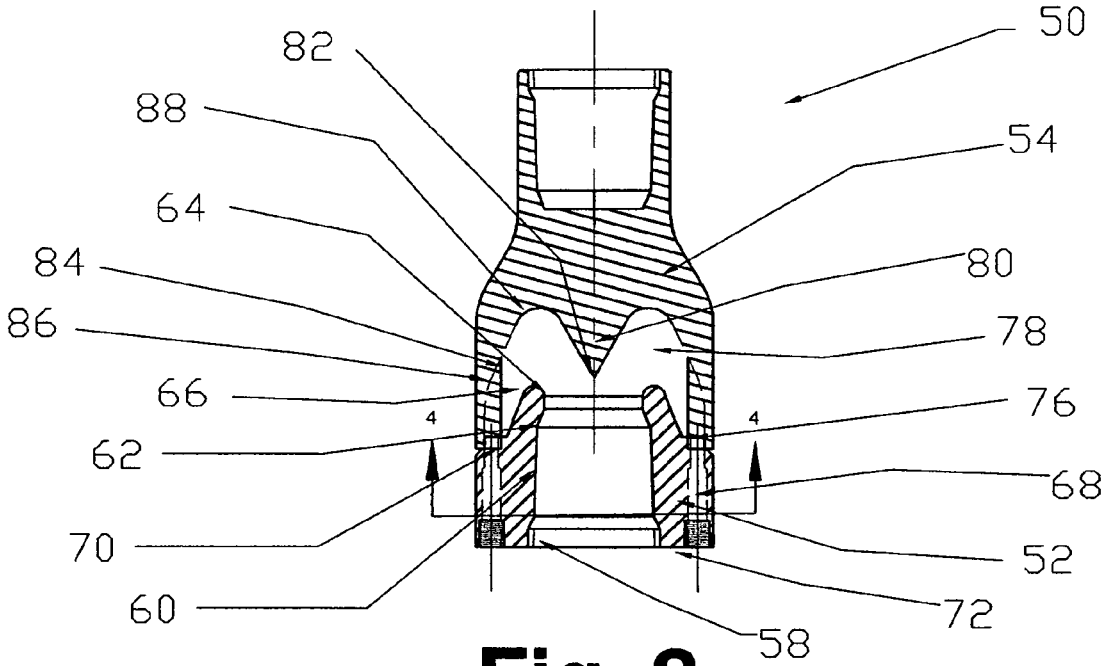
FIG. 3 is a longitudinal cross-sectional view of an upper flow reversing head assembly.
Figure 4:
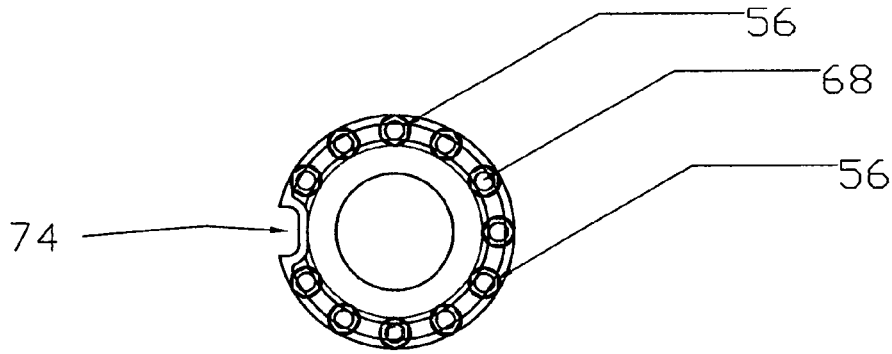
FIG. 4 is a cross-sectional view taken along the line 4-4 of FIG. 3.

FIG. 3 is a longitudinal cross-sectional view of flow reversing head 50, showing flow diverter 54 and flow divider 52, each of which components is coaxial with the other component. Inner flow divider 52, which is of annular form, includes an internally threaded inlet 58 for connection with pump discharge conduit 48 to receive water flow that issues from pump 16. Inlet 58 communicates with a cylindrical flow channel 60 that terminates at a converging section 62 that is immediately upstream of flow outlet 64. The outlet includes an annular lip 66 that extends into the interior of flow diverter 54. Additionally, and as shown in cross section in FIG. 4, positioned outwardly of and substantially parallel to cylindrical flow channel 60 are a series of circumferentially spaced, axially disposed outer flow passageways 68 that extend from an inwardly-directed annular step 70 to end face 72 of flow divider 52. A longitudinally-extending cable groove 74 is provided in the outer surface of the flow divider between two of outer flow passageways 68 to accommodate an electrical cable (not shown) for providing electrical power to pump motor 18.

Referring once again to FIG. 3, flow diverter 54 is of generally circular cross-sectional form and includes a lower end 76 of generally annular form that defines a circumferential flange that is received on and is in surface-to-surface contact with inwardly-directed annular step 70 of flow divider 52. Flow divider 52 and flow diverter 54 are joined together by a circumferential weld at the outer edge of the circumferential flange-annular step interface.

Flow diverter 54 includes an inner annular chamber 78 that includes a centrally-positioned, conical flow splitter 80. The flow splitter extends into inner annular chamber 78 and includes a pointed apex 82 that is spaced axially from flow outlet 64 of flow divider 52 from about 0.1 in. to about 0.4 in. Inner annular chamber 78 has an outer wall surface 84 that is of generally cylindrical form and that includes a series of circumferentially spaced, axially-extending inner arcuate recesses 86 (see FIG. 5) that are equal in number to, that are equal in circumferential spacing to, and that have radii that are substantially equal to those of outer flow passageways 68 of flow divider 52. Between conical flow splitter 80 and outer wall surface 84 of inner annular chamber 78 is a chamber annular end wall surface 88 that is concavely curved and that can have a radius of from about 0.5 in. to about 2.0 in. End wall surface 88 provides a smooth, uninterrupted transition between the outer surface of conical flow splitter 80 and the inner surfaces of arcuate recesses 86. As also shown in FIG. 5, the outer surface of flow diverter 54 includes a cable groove 90 that is aligned with cable groove 74 provided in flow divider 52.

Figures 5, 6:
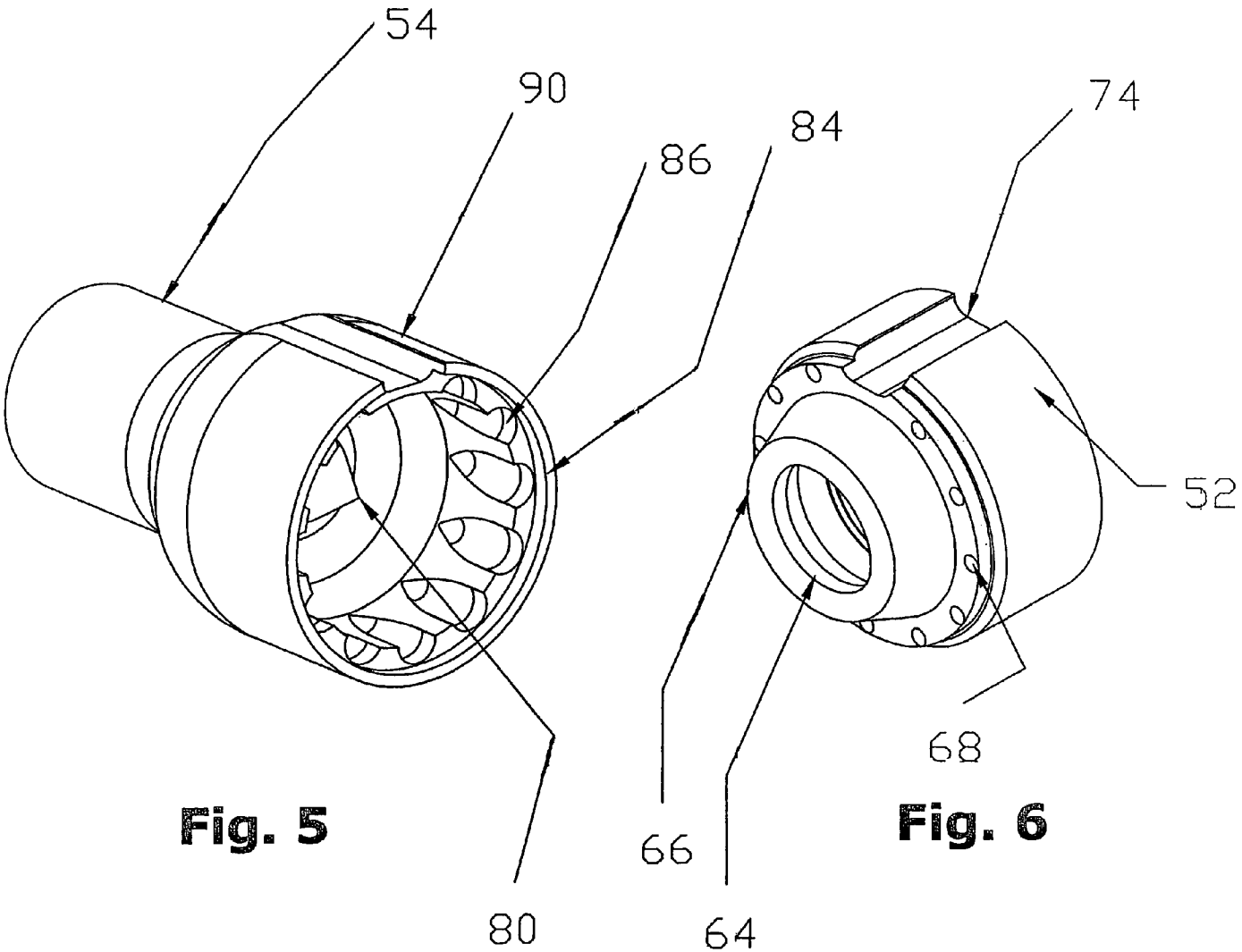
FIG. 5 is a perspective end view of the flow diverter of the upper portion of the flow reversing head assembly shown in FIGS. 2 and 3, as viewed from the lower end of that assembly.
FIG. 6 is a perspective view of the lower section of the upper flow reversing head assembly as viewed from the upper end of that section.
Figure 7:
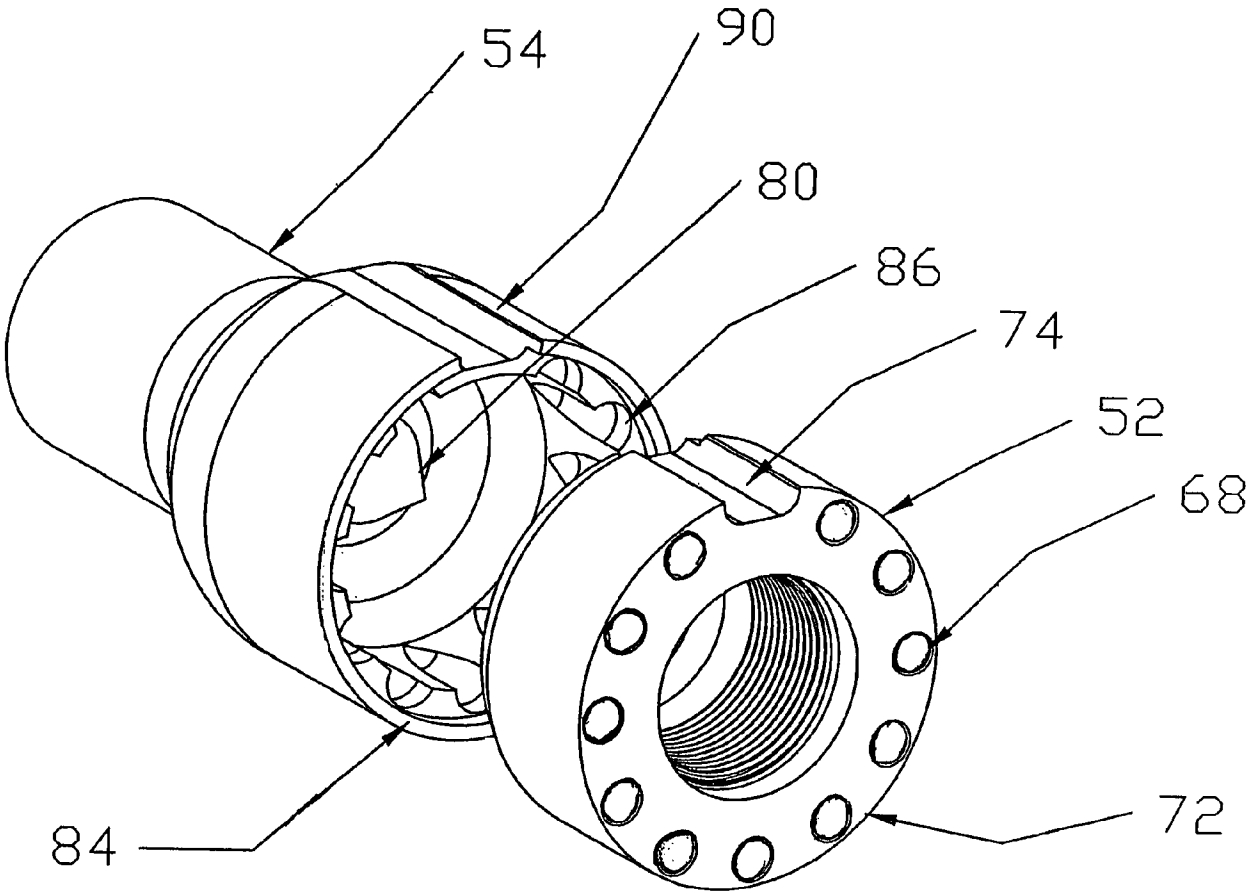
FIG. 7 is an exploded perspective view of the upper flow reversing head assembly.

The interior of flow diverter 54 is clearly shown in the perspective view of FIG. 5, in which the form of inner arcuate collector recesses 86 is visible. And when flow reversing head 50 is in assembled form, as shown in FIG. 3, the circumferentially disposed inner collector recesses 86 in flow diverter 54 each communicate with a respective one of the circumferentially disposed water outlet flow passageways 68 in flow divider 52, which are also clearly shown in the perspective view of flow divider 52 in FIG. 6. Further, as shown in the exploded view of FIG. 7, flow diverter 54 and flow divider 52 are circumferentially arranged so that the respective electrical cable grooves 74, 90 are aligned with each other to allow the electrical cable (not shown) to pass from a source of electrical power at the well upper surface to pump motor 18.

Figure 8:
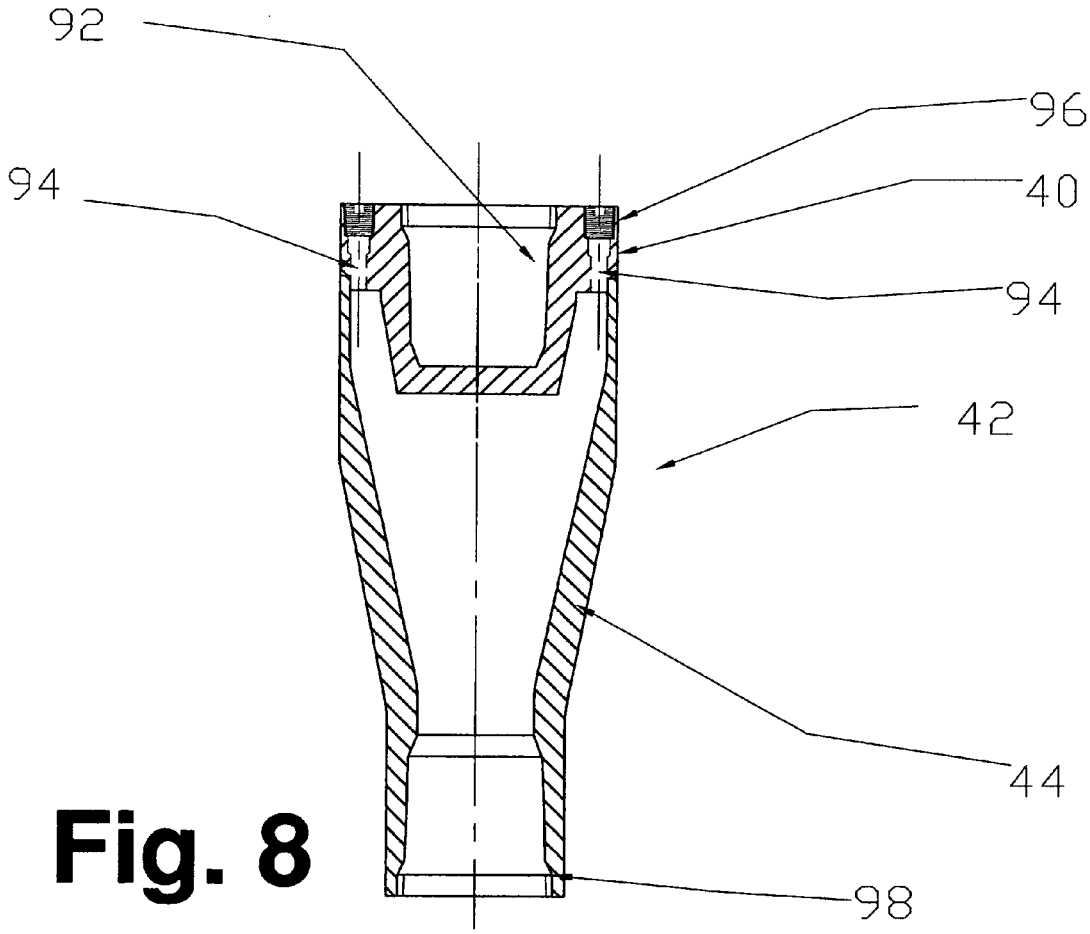
FIG. 8 is a longitudinal cross-sectional view of the downstream collection head for collecting and directing reversed flow.

Referring now to FIG. 8, downstream flow collector 42 includes inner collector head 40 and outer collector conduit 44. Inner collector head 40 is a substantially cup-shaped member that includes an inner threaded recess 92 for receiving an outer threaded pump motor connector for supporting motor 18. A number of circumferentially spaced, axially-extending flow passageways 94, corresponding in number and in radial and circumferential position with respective outer conduits 56 extending from flow divider 52, are provided in annular outer wall 96 of inner collector head 40. Flow passageways 94 open into the interior of outer collector conduit 44, which, as shown, can be of converging form from the connection with inner collector head 40 and the flow outlet 98 of outer collector conduit 44.

Figure 9:
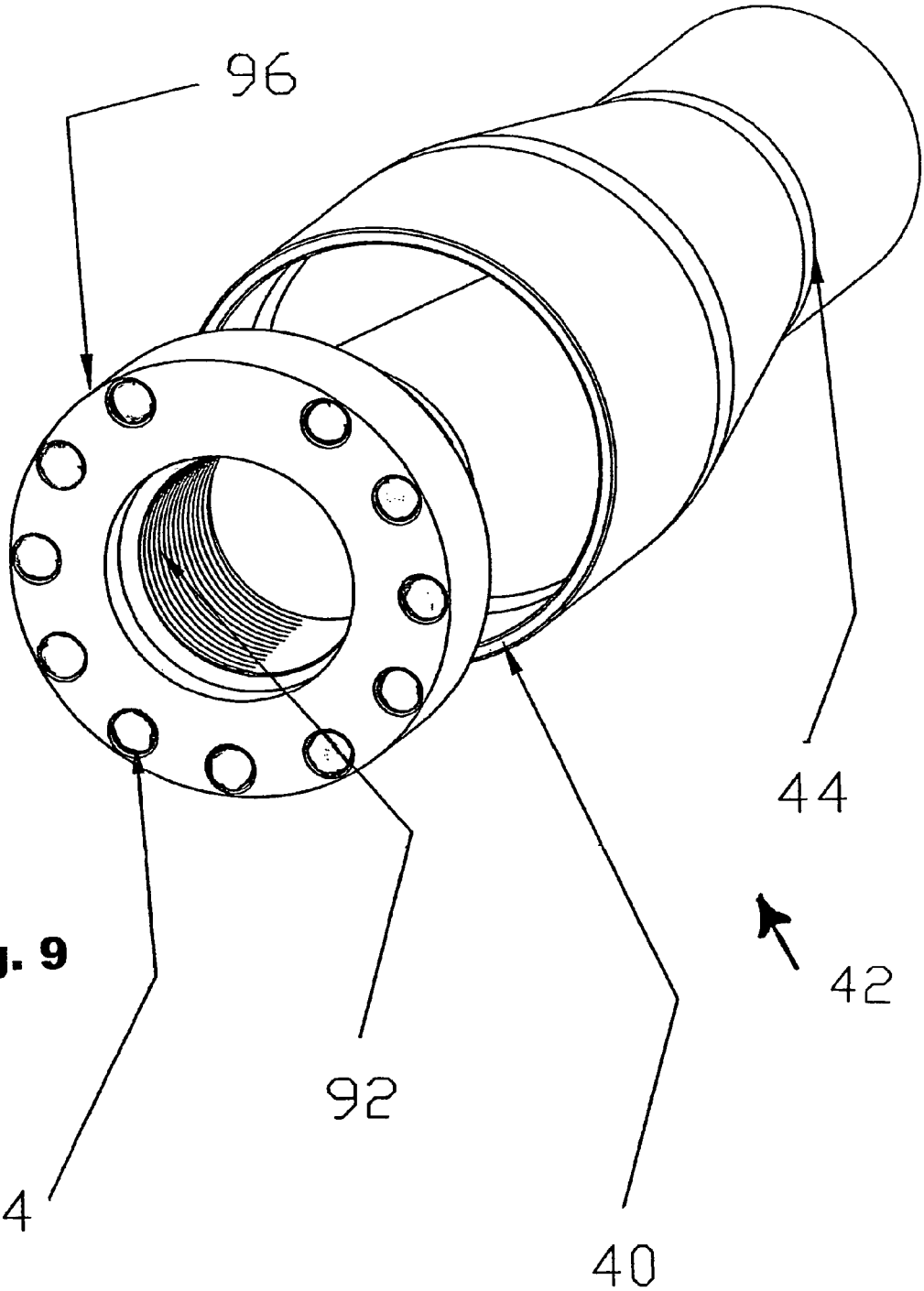
FIG. 9 is an exploded perspective view of the components of the downstream collection head assembly as viewed from the top of that assembly.

FIG. 9 shows an exploded perspective view of downstream flow collector 42, in which inner threaded recess 92 and the circumferentially-spaced flow passageways 94 in inner collector head 40 are clearly visible. Outer collector conduit 44 and inner collector head 40 are joined to each other by a circumferential outer weld (not shown). As earlier noted, and as shown in FIG. 2, outer conduits 56 extend between and interconnect flow reversing head 50 and downstream flow collector 42. The number and orientation of outer conduits 56 corresponds with the number and orientation of flow passageways 68, 94 in each of flow divider 52 and inner collector head 40, respectively.

In operation, and as viewed in FIGS. 2 and 3, pump motor 18 is energized to drive pump 16, which, as shown, can be a centrifugal pump. By virtue of the sealing arrangement 34, which can be a mechanical packer, and the upper casing openings 36, water in upper coal bed seam 28 is drawn from the seam and into pump 16, which directs the withdrawn water into flow reversing head 50. In the meantime, methane gas that is liberated as a result of the withdrawal of the water from upper coal seam 28 enters annular passageway 20 between well casing 14 and the pump/motor assembly, from which the methane gas is withdrawn at the wellhead at methane gas outlet 26.

The water that is discharged from pump 16 flows through flow channel 60 of flow divider 52 and exits through flow outlet 64 and into inner annular chamber 78 of flow diverter 54. The water flow stream leaving the outlet of the pump impinges against conical flow splitter 80, which deflects the flow stream and directs it radially outwardly over 360° along annular end wall surface 88 of annular chamber 78 and redirects the flow into the several peripheral collector recesses 86 of flow diverter 54. The water flow stream thus undergoes a 180° reversal of flow direction within flow diverter 54, from an upward axial direction to a downward axial direction, and shifts the flow stream radially outwardly of the longitudinal axis of flow diverter 54.

After entering peripheral collector recesses 86, which divides the flow into a number of individual flow paths, the water flows enter the several outer water flow passageways 68 in flow divider 52. From flow divider 52, the individual water flows enter into and flow within each of the several outer conduits 56 to inner collector head 40 of downstream flow collector 42, from which the several individual water flows enter outer collector conduit 44, where they rejoin into a single flow stream to issue from collector tube flow outlet 98 into water downflow tube 30, and then into the lower annular chamber defined between sealing means 34, well casing 14, and the floor of the well. By virtue of the pressure under which the water is discharged by pump 16, the water passes through lower casing openings 38 and into lower seam 32, thereby disposing of the extracted upper coal seam water and obviating water disposal problems at the wellhead.

Although particular embodiments of the present invention have been illustrated and described, it will be apparent to those skilled in the art that various changes and modifications can be made without departing from the spirit of the present invention. Accordingly, it is intended to encompass within the appended claims all such changes and modifications that fall within the scope of the present invention.

What is claimed is:

1. A downhole pumping system for a coal bed methane well, said pumping system comprising:

a. a well casing extending into the earth within a unitary well bore to a predetermined depth below the earth's surface, the well casing including a plurality of first casing openings adjacent a first subterranean coal seam containing coal, water, and coal bed methane gas, and a plurality of second casing openings spaced in a downward direction of the well casing from the first casing openings and positioned adjacent a second subterranean seam that is spaced from and is at a lower depth below the surface of the earth than is the first subterranean seam;

b. a motor-driven pump supported within the well casing, the pump including a pump inlet for withdrawing water from the first subterranean seam to reduce pressure of the withdrawn water and thereby liberate the methane gas, and including a pump outlet for discharging under pressure water withdrawn from the first subterranean seam;

c. a water downflow pipe within the well casing and inward of a well casing inner surface, wherein the water downflow pipe is in fluid communication with the pump outlet for receiving pump outlet flow;

d. a sealing arrangement within the well casing at a depth between the first subterranean seam and the second subterranean seam, the sealing arrangement extending across the well casing interior between the well casing inner surface and the water downflow pipe to prevent communication within the well casing between the first casing openings and the second casing openings; and e. a flow redirection means within the well casing and opposite the pump outlet for directing pump outlet flow in a downward direction relative to the first subterranean seam to the second casing openings adjacent the second subterranean seam so that water withdrawn from the first subterranean seam is directed into the second subterranean seam, wherein the flow redirection means includes a flow reversing head for redirecting upward flow from the pump to downward flow around and past the pump and motor and to a downstream flow collector for receiving the downward flow and for directing the downward flow into the downflow conduit, the flow reversing head including a flow diverter positioned opposite the pump outlet and a flow divider for receiving reversed flow and for conveying the reversed flow in a downward axial direction, the flow diverter including a conical flow splitter and a curved, surrounding annular end wall surface for diverting the flow from an upward direction to a downward direction, including a plurality of tubular conduits disposed about the pump and the motor and extending between and providing fluid communication between the flow redirection means and the downstream flow collector, wherein the tubular conduits are substantially equally circumferentially positioned about the pump and the motor.

2. A downhole pumping system in accordance with claim 1, wherein the pump is a centrifugal pump.

3. A downhole pumping system in accordance with claim 2, wherein the pump inlet is adjacent the first subterranean seam.

4. A downhole pumping system in accordance with claim 1, including a submersible electric motor within the well casing and operatively connected with the pump.

5. A downhole pumping system in accordance with claim 1, wherein flow issuing from the pump outlet is oriented to flow in an upward direction relative to the well casing.

6. A downhole pumping system in accordance with claim 1, wherein the flow redirection means receives upward flow from the pump and redirects it downwardly into the water downflow pipe carried within the well casing and that extends through the sealing arrangement.

7. A downhole pumping system in accordance with claim 1, wherein the downstream flow collector includes an inner collector head for receiving flow from the flow reversing head, and an outlet collector conduit connected with the downflow conduit.

8. A downhole pumping system in accordance with claim 7, wherein the inner collector head supports the electric motor.

9. A downhole pumping system in accordance with claim 1, wherein the flow divider receives a pump outlet conduit for supporting an upper portion of the pump.

10. A downhole pumping system in accordance with claim 1, wherein the flow divider extends into the flow reversing head and terminates spaced a predetermined distance away from the conical flow splitter.

* * * * *